US006585533B1

(12) United States Patent
Sullivan et al.

(10) Patent No.: US 6,585,533 B1
(45) Date of Patent: Jul. 1, 2003

(54) VIBRATION RESISTANT ELECTRICAL CONNECTOR

(75) Inventors: John P. Sullivan, Arlington Heights, IL (US); Joseph F. Murphy, Waukegan, IL (US); Bradley J. Holmes, Chicago, IL (US)

(73) Assignee: Woodhead Industries, Inc., Deerfield, IL (US)

( * ) Notice: Subject to any disclaimer, the term of this patent is extended or adjusted under 35 U.S.C. 154(b) by 0 days.

(21) Appl. No.: 10/229,171

(22) Filed: Aug. 28, 2002

(51) Int. Cl.[7] ..... H01R 4/38; H01R 13/627
(52) U.S. Cl. ..... 439/254; 439/357
(58) Field of Search ..... 439/254, 253, 439/320, 322, 357

(56) References Cited

U.S. PATENT DOCUMENTS 4,801,277 A 1/1989 Seilhan ..... 439/680
5,100,341 A * 3/1992 Czyz et al. ..... 439/447
5,418,874 A 5/1995 Carlisle et al. ..... 385/76
5,888,083 A 3/1999 Seilhan et al. ..... 439/161
5,906,513 A 5/1999 Peterson et al. ..... 439/607
6,398,586 B1 * 6/2002 Muzslay ..... 439/606
6,435,911 B1 * 8/2002 Payson et al. ..... 439/606
6,461,179 B1 10/2002 Sullivan et al. ..... 439/254

* cited by examiner

*Primary Examiner*—Chandrika Prasad
(74) *Attorney, Agent, or Firm*—Emrich & Dithmar

(57) ABSTRACT

A quick disconnect electrical connector resistant to vibration-induced disconnect includes a male connector and a female connector each having opposing segments of flexible thread which inter-engage when the male and female are assembled. The thread segments of the female connector are on a flexible wall which deflects to permit mating engagement when the two connectors are pushed together. A peripheral rim is formed in the overmold of one connector and a mating groove is formed in the overmold of the other, mating connector to form a tactile indicator that the connection is complete and to secure the two mating connectors together.

15 Claims, 16 Drawing Sheets

VIBRATION RESISTANT ELECTRICAL CONNECTOR

FIELD OF THE INVENTION

The present invention relates to electrical connectors; and more particularly, it relates to electrical connectors of the type which are referred to generally as "quick disconnect" connectors and which are used in commercial and industrial applications, particularly in the field of industrial automation and manufacturing.

BACKGROUND OF THE INVENTION

Typically, quick disconnect connectors for commercial and industrial applications of the type with which the present invention is concerned, include a male connector and a mating female connector. The male connector has metal connecting elements in the form of pins; and they are received in corresponding sockets or receptacles embedded in the mating female connector. Typically, these connectors have two to five poles plus a ground connection.

An important aspect of quick disconnect connectors is that there be some mechanical coupling to secure the male and female connectors together and maintain electrical continuity. Typically, in connectors of this type, the female connector (or the male) is provided with a mating threaded coupling member (such as a coupling nut); and the mating connector is provided with a mating threaded coupling portion so that after the electrical connection is established, the coupling members provide a mechanical connection securing the electrical connection. In some applications where the handling of the connectors may be often and perhaps somewhat rough, as well as in applications where the connectors are mounted to a machine and undergo periodic or continuous vibration, there is a tendency for the coupling nut to back off from its threaded engagement with the male connector, thus creating the possibility of an inadvertent or unintentional disconnect.

In addition to the problems mentioned above concerning the possibility that the male and female connectors may become disconnected as a result of vibration or handling, there is also a disadvantage with existing quick disconnect connectors in that it takes an appreciable time to secure a connection, primarily in manually threading the coupling nut of one connector onto the other connector. The amount of time for assembling a single connector combination may not be significant in an absolute sense, but when it is considered that in a large manufacturing environment there are literally thousands of such connectors around and that machines and control systems employing the connectors are continuously being re-positioned, tested and re-assembled, over the period of months or a year, the amount of time required to assemble and disassemble threaded coupling nuts has proved to be appreciable.

Co-owned, copending U.S. application Ser. No. 09/945,970, filed Sep. 4, 2001, discloses a vibration resistant, quick disconnect connector having thread segments of flexible material which permits male and female connectors to be assembled simply by pushing them together. The female connector has the flexible thread segments on a flexible wall which deflects to permit mating engagement when pushed onto a male connector.

Such flexible-thread connectors work very well when assembled to a corresponding mating conventional connector having threads of matching pitch.

Typically, such conventional connectors have threads of metal or rigid plastic; and the inter-engagement of flexible thread segments with full mating threads of rigid material has been found to be satisfactory because the act of connecting the two is simplified, and the resistance to vibration-induced disconnect is acceptable. However, in the case of female to male inter-engagement with mating connectors both having flexible threads the connection leaves something to be desired for two reasons. First, there is little or no tactile feeling that the connection has been completed; second, because the crests of flexible threads may be somewhat lower than for rigid threads, the ability to resist vibration-induced disconnect is less than desired.

SUMMARY OF THE INVENTION

The present invention contemplates that one of the electrical connectors (the female in the embodiment shown) have a cylindrical wall surrounding and spaced from an insulating insert in which connecting elements in the form of sockets are embedded. The cylindrical wall of the female connector is made of molded plastic, such as polyvinyl chloride (PVC) and has a flexibility such that it may be deformed upon insertion of a mating male connector in order to receive and engage with the mating thread segments of the male connector without a turning or twisting motion. The interior surface of the cylindrical wall of the female connector is provided with first and second diametrically located, discrete segments of internal threads arranged in opposing relation. That is, one segment of internal threads may extend for approximately 90 degrees about the interior of the cylindrical wall; and a second segment of internal threads is arranged in opposing or facing relation and located on the interior surface of the opposite side of the peripheral wall. Between the two segments of thread, the wall is free of thread and may be smooth and cylindrical.

When used in connection with the present invention, the term "thread" includes not only conventional screw threads, extending helically about a central axis, but also a series of alternating ridges or crests and troughs arranged perpendicular to the longitudinal axis of the connector (sometimes referred to as "parallel" threads). Conventional screw threads may be preferred because they are compatible with the screw threads found on the many existing metal or rigid plastic coupling nuts and male connectors found in manufacturing plants. However, parallel threads, when provided in discrete segments as disclosed, will engage and can be assembled by pushing two mating connectors together because the threads are flexible and they are provided in discrete segments so they will ride over one another upon assembly. Parallel threads will provide sufficient interlocking to require separating or pull forces in a desirable range to resist unintentional disconnects. Moreover, a "thread" includes at least two adjacent crest/trough combinations, whether parallel or helical.

The male connector preferably has corresponding, matching opposing segments of external thread on an outer cylindrical surface. The male and female connector inserts are keyed together so that when the keyway of the female is aligned with the key of the male connector, the matching thread segments are also aligned.

The male connector may then be inserted into the female connector by pushing the male connector directly into the female connector after the respective key and keyway have been aligned. In assembling the male connector to the female connector, the wall of the female connector deflects as the external thread segments of the male connector are assembled to the mating thread segments female connector. In other words, the outer wall of the female connector deforms into an elliptical form so that the interior threads of the female connector ride over the corresponding thread segments of the male connector.

Once the two connectors are assembled, the threads inter-engage (whether parallel or helical types). The connection is highly resistant to vibration-induced disconnect because the male connector cannot be rotated relative to the female connector since they are keyed together. Moreover, it has been found that a substantial but adjustable pull force (in the range of ten to thirty pounds, for example) may be designed into the assembled connectors, depending upon the hardness of the material used in molding the cylindrical wall of the female connector on which the thread segments are formed and other factors.

It will be appreciated that the assembly time for establishing an electrical/mechanical connection with the improved connectors is substantially reduced. Moreover, the female connector of the present invention (with screw threads) is adaptable to mate with existing male connectors having external metal or other rigid threads, and the male version of the instant connector with flexible screw threads is equally adaptable to assembly with existing interior metal threads of rigid coupling nuts. The male connector of the present invention may be pushed directly into the existing coupling nuts of female connectors, or, if desired, the coupling nuts can be threaded onto the thread segments of the male connectors constructed according to the present invention.

In order to improve the coupling of a male and a female connector, each having flexible threads, the present invention provides an annular groove at the forward end of one set of thread segments, typically, but not necessarily, located on the female connector and located on the interior surface of the flexible wall. A mating annular rib or rim is provided at the base of the exterior thread of the male connector. When the two connectors are aligned and assembled with a linear, pushing motion, the thread segments ride over one another, the outer wall of the female connector flexing to receive the male; and, as the engagement becomes complete, the annular rim of the male connector snaps into engagement with the annular groove of the female. This provides both a sensible, tactile feel of completion of the connection, and a solid mechanical coupling to resist disconnect of the mating flexible threads.

Further, the outer surfaces of the overmold bodies, for both male and female are shaped and textured to facilitate gripping and disconnecting with the fingers of both hands.

Other features and advantages of the present invention will be apparently to persons skilled in the art from the following detailed description of a preferred embodiment accompanied by the attached drawing wherein identical reference numerals will refer to like parts in the various views.

DETAILED DESCRIPTION OF THE PREFERRED EMBODIMENT

Figure 1:
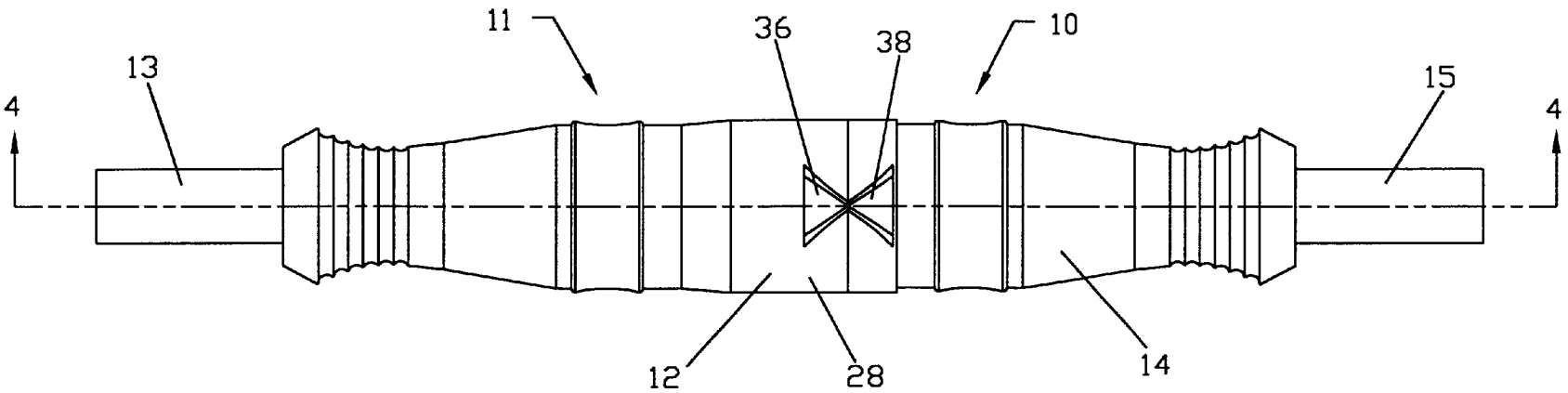
FIG. 1 is a side view of a male connector and female connector constructed according to the present invention in assembled relation.
Figure 2:
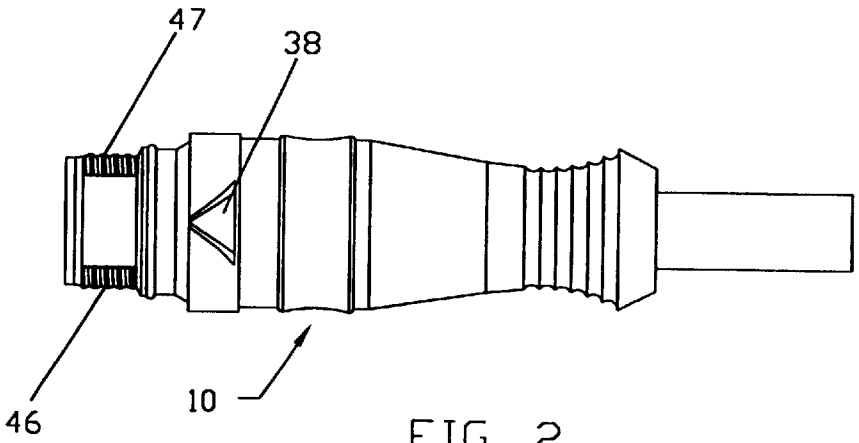
FIG. 2 is a bottom view of the male connector of FIG. 1.
Figure 3:
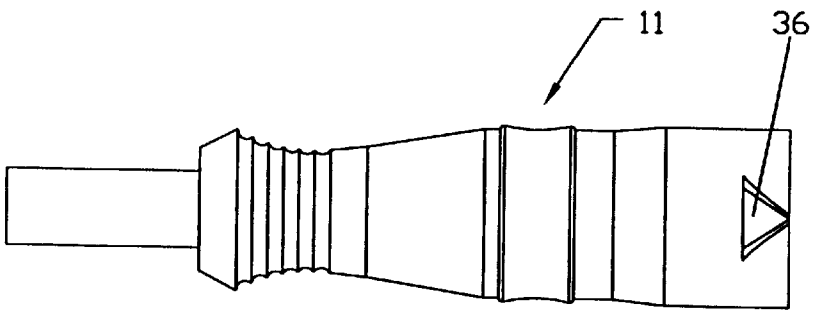
FIG. 3 is a bottom view of the female connector FIG. 1.

Referring to FIGS. 1–3, reference numeral 10 generally designates a male electrical connector, and reference numeral 11 generally designates a female electrical connector. The connectors 10, 11 are shown in assembled relation in FIG. 1, the male connector is shown in bottom view in FIG. 2, and the female connector is similarly shown in FIG. 3. As used herein, the terms "forward" or "distal" with reference to a connector, whether male or female, refers to the connecting end—that is, the end which couples to the mating connector. The terms "proximal" or "rear" refer to the portion of a connector closer to its associated cable. "Top" and "bottom" are used for reference only, and do not designate any particular use side.

Turning first to the female connector 11, it is shown in greater detail in FIGS. 8 through 13. However, as seen in FIGS. 1 and 3, the exterior of the female connector includes an overmold body (or simply "overmold") designated 12 which encompasses the connecting elements, to be described. The connecting elements may be conventional, and they are conventionally connected to the individual wires of a jacketed cable 13. The overmold body 12, as is known, provides a protective coating over the juncture between the cable 13 and the individual connector elements of the connector 11, as will be described. Moreover, the overmold 12 provides a protective sheath and strain relief for the connector. Similarly, the male connector includes an overmold body 14 and it may be connected to the individual wires of a cable 15. The overmold bodies 12, 14 are made of molded plastic such as polyvinyl chloride.

Figure 9:
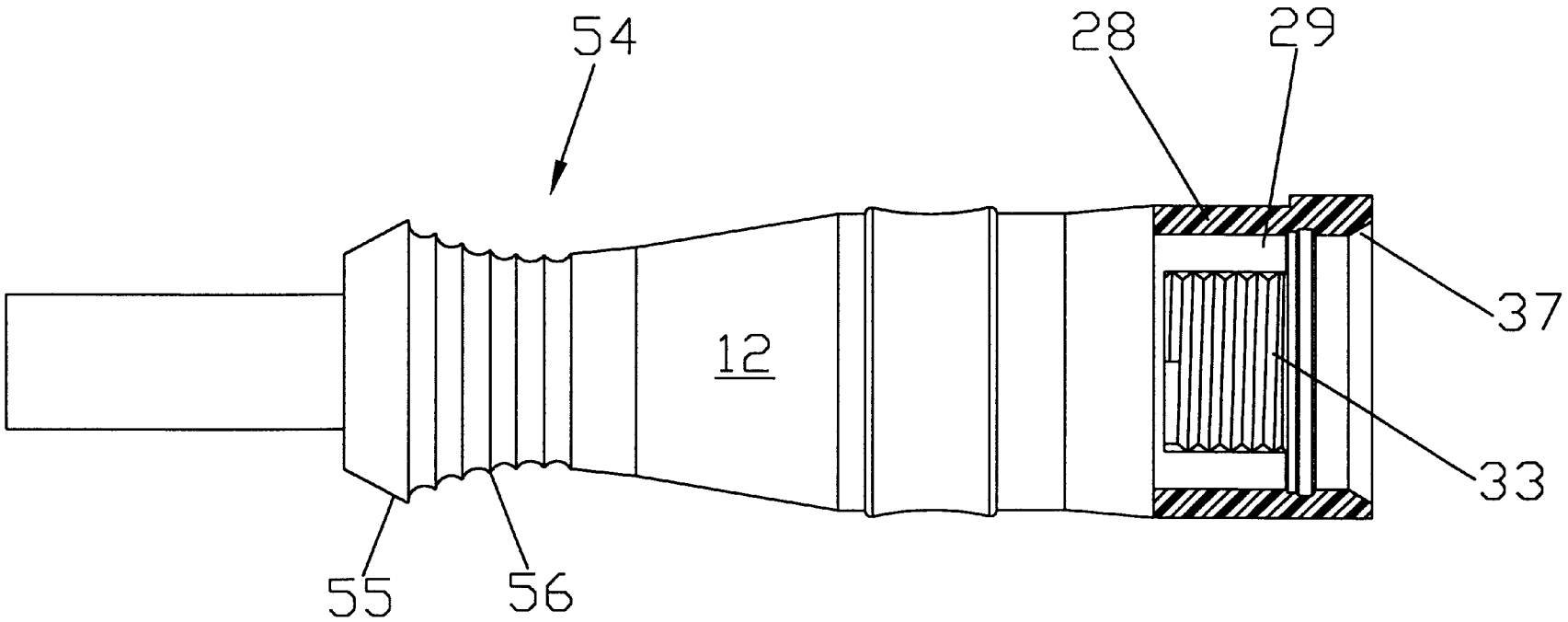
FIG. 9 is a side view of the female connector of FIG. 1 with a partial section of the connecting end thereof, taken along the section line 9—9 of FIG. 8.
Figure 10:
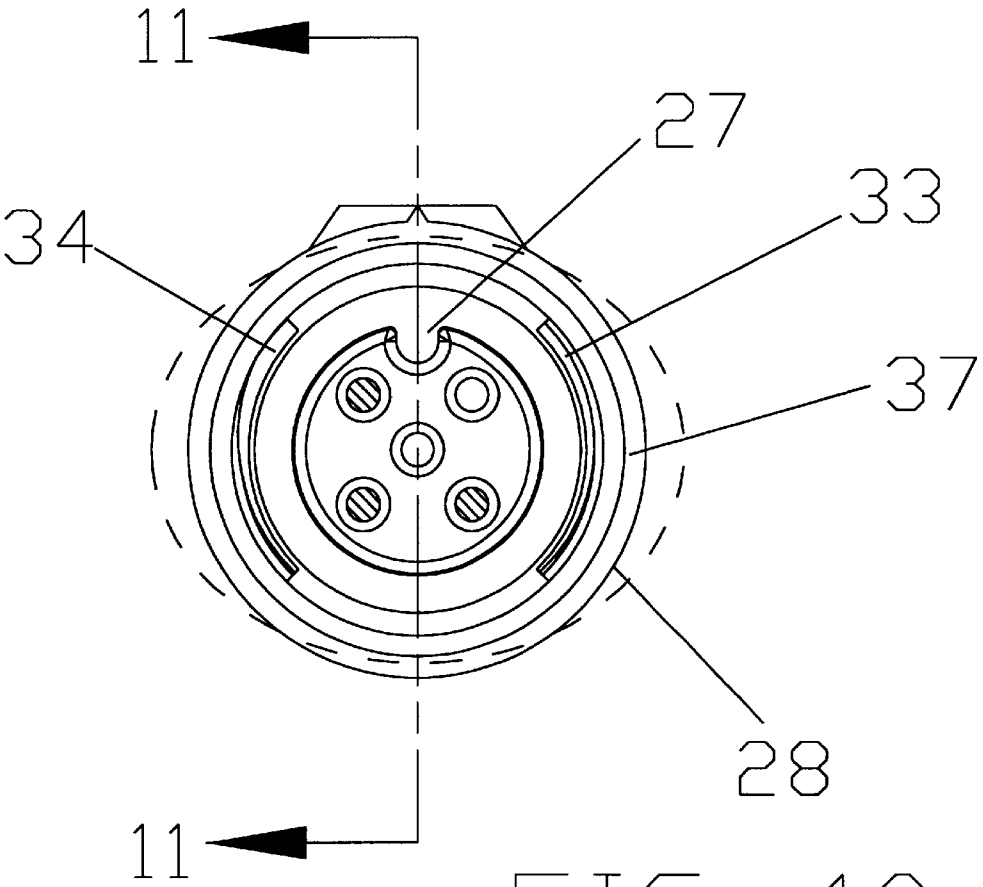
FIG. 10 is a view similar to FIG. 8 of the female connector showing deflection of the flexible wall connection.
Figure 11:
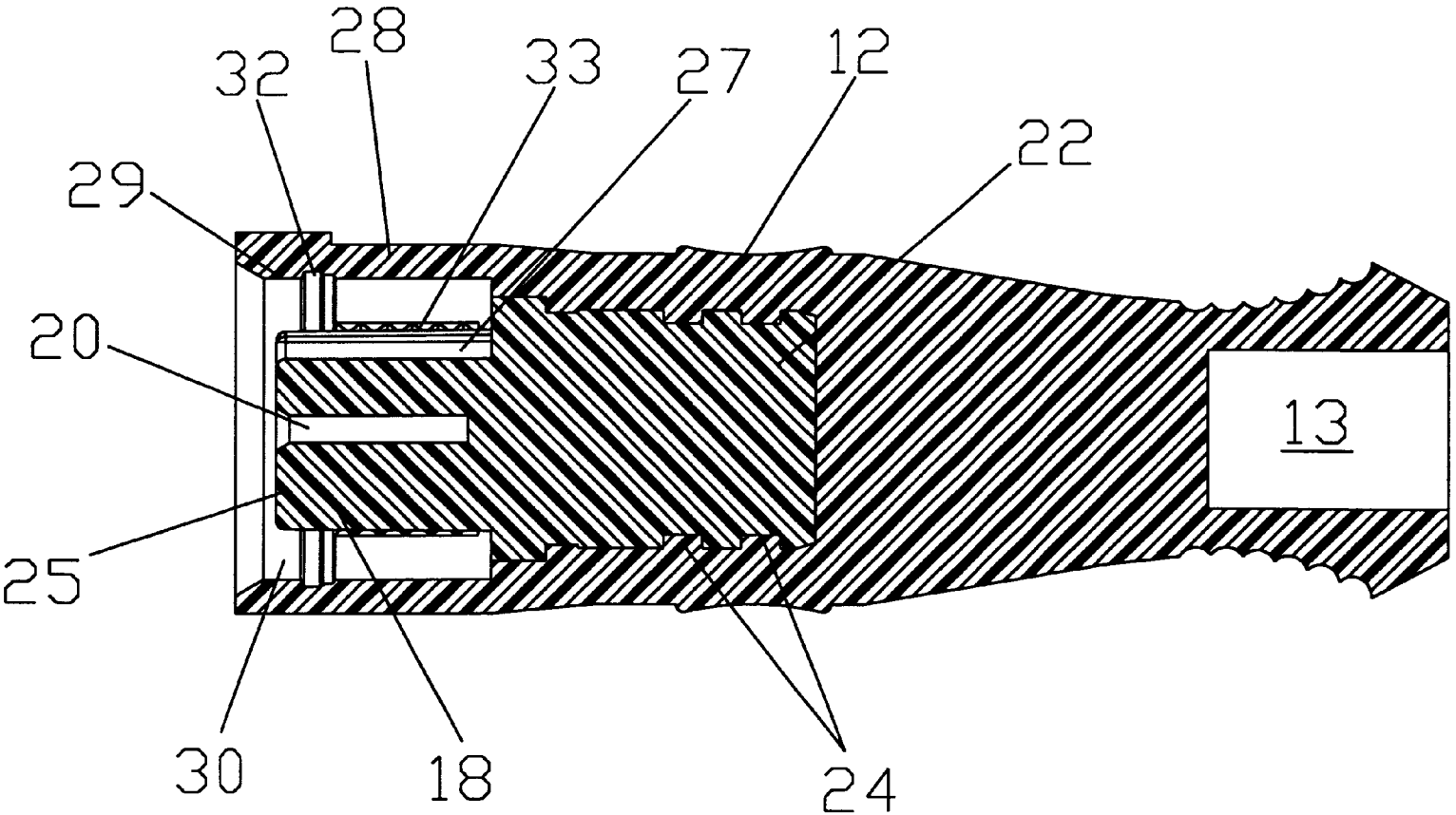
FIG. 11 is a cross section view of the female connector taken along the section line 11—11 of FIG. 10.
Figure 12:
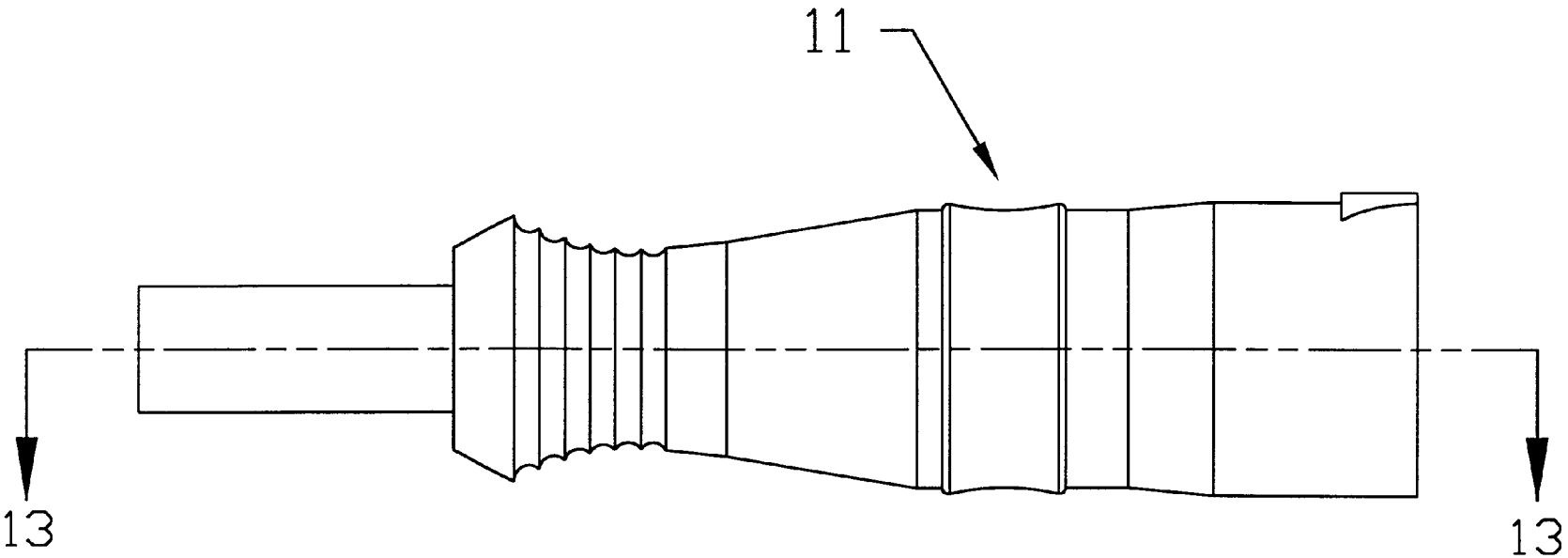
FIG. 12 is a side view of the female connector of FIG. 1.

Turning then to the female connector 11 as seen in FIGS. 8–13, it includes an insert body 18 of rigid plastic material and having insulating properties to receive and support individual female connecting elements 19 which are conventional sleeves or receptacles, and a separate, central sleeve 20 for a ground connection. Referring particularly to FIG. 11, the female insert 18 includes a base 22 on which the overmold 12 is formed. To provide greater mechanical bonding with the overmold 12, the base 22 of the insert may be provided with peripheral grooves such as those designated 24 in FIG. 11. Extending forwardly (to the left in FIG. 11) the insert 18 includes a generally cylindrical projecting portion 25 integral with the base 22, and forming a rigid body for holding and supporting the electrical connecting elements 19, 20.

Figure 8:
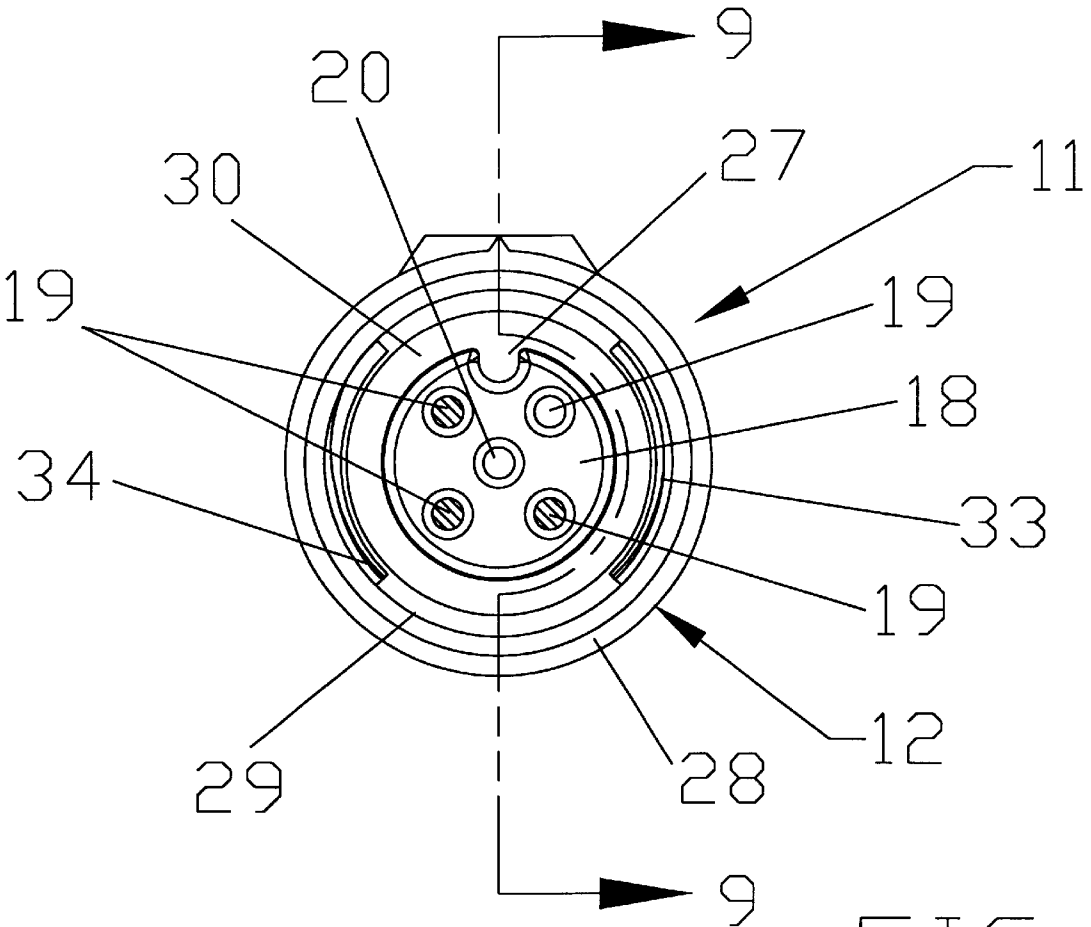
FIG. 8 is an end view of the female connector of FIG. 1 looking at the connecting end thereof.

As best seen in FIGS. 8 and 11, a keyway or slot 27 is formed in the cylindrical projecting portion 25 which has a diameter less than that of the base 22 in the embodiment shown. Moreover, at the forward portion of the overmold 12, there is formed a cylindrical wall 28 which surrounds the projecting portion 25 of the insert 18. An interior cylindrical surface 29 of the cylindrical wall 28 of the overmold is spaced from the cylindrical side of the projecting portion 25 of the insert 18 to form an annular space generally designated 30 which, as will be described, receives a surrounding wall of the male connector.

Turning now particularly to FIGS. 8–10, the interior cylindrical surface 29 has integrally molded onto it, first and second segments of inner threads. These two segments are designated respectively 33 and 34. The threads may be formed in the pattern of a continuous helical thread (screw thread). That is, the crests and troughs of the threads on a segment 33 form the same pitch as, and lead into the threads on the segment 34. The threads are interrupted however. Moreover, the threads may be a standard thread of screw type found in conventional connectors of this type having coupling nuts with interior threads, in which case, of course, the threads are rigid and continuous, such as a conventional 12 m×1 thread.

Figure 4:
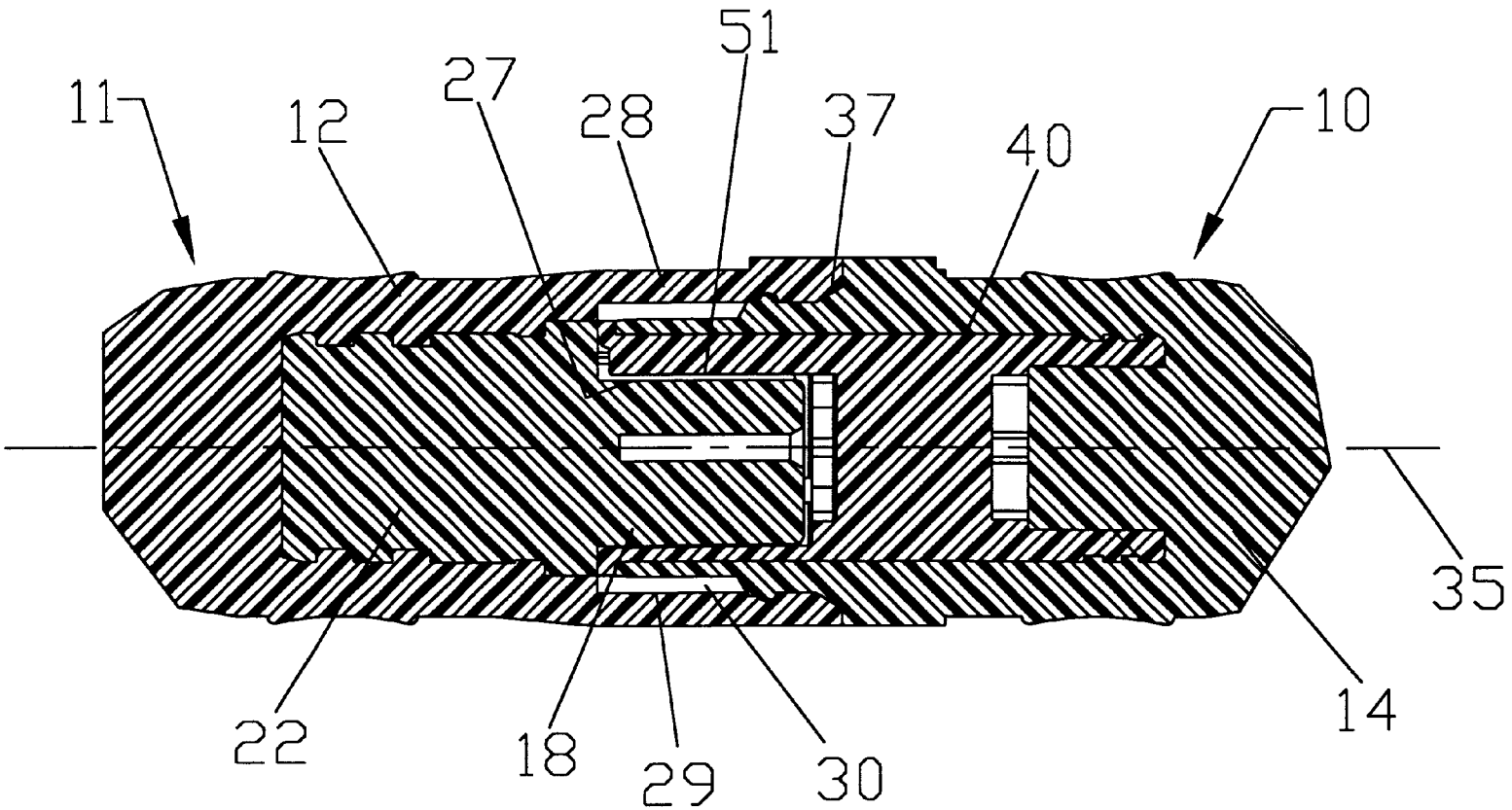
FIG. 4 is a cross sectional view of the assembled male and female connectors of FIG. 1 shown in partial form and taken through the section line 4—4 as seen in FIG. 1.
Figure 5:
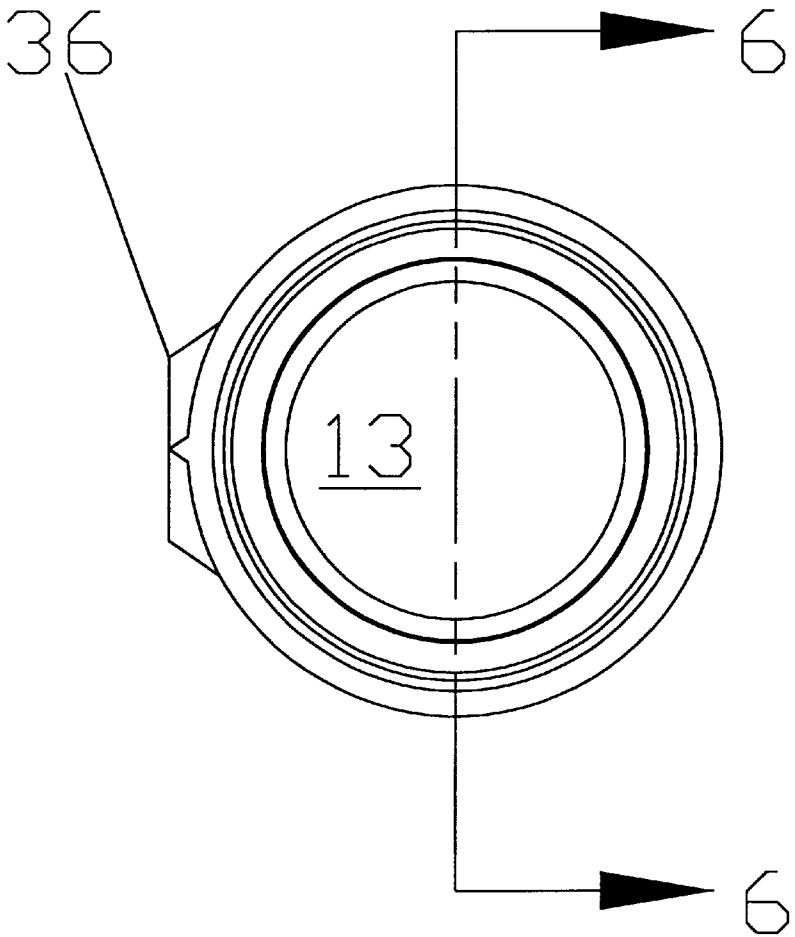
FIG. 5 is an end view of the complete male and female connectors seen in FIG. 1 taken from the right side thereof.

Alternately, the threads may be parallel—that is, arranged in planes perpendicular to the axis of the connector, designated 35 in FIG. 4. The thread segments 33, 34 are molded as an integral part of the overmold 12, and therefore made of the same material and flexible. The molding material may be a polyvinyl chloride, and have a durometer rating in the range of approximately 70–100 on the Shore A scale. For the standard thread size indicated above, a durometer rating of 80 on the Shore A scale provides a 15 pound pull force required to disconnect the female connector from the male connector to be described. A durometer rating of 92 on the Shore A scale for the structure described results in a pull force of approximately 25 pounds to disconnect the male and female connectors.

Persons skilled in the art will appreciate that pull forces may be designed over a wide range by adjusting the number of threads, the included angle over which the thread segments extend and the hardness of the molding material of the overmold body. Depending on the dimensions and intended application, hardness ratings ranging from 30 to 40 on Shore A to 75 on the Shore D scale will work, but with correspondingly less or greater pull force required to disconnect.

Figure 7A:
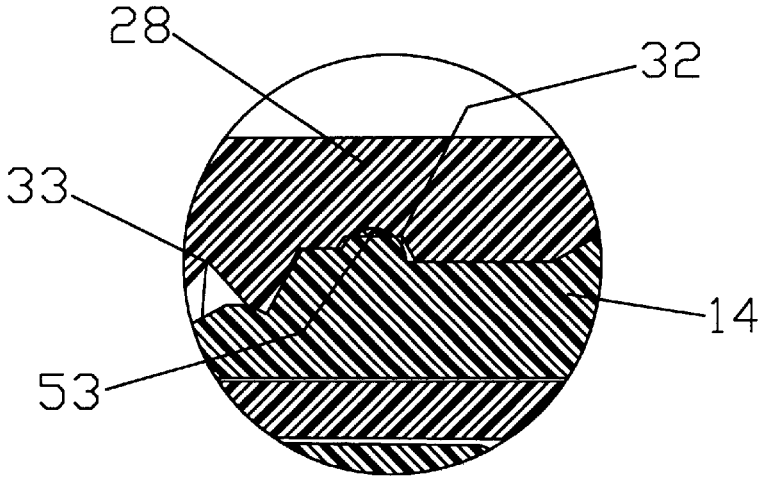
FIG. 7A is an enlarged view of the portion of FIG. 7 within the circle 7A thereof.
Figure 7:
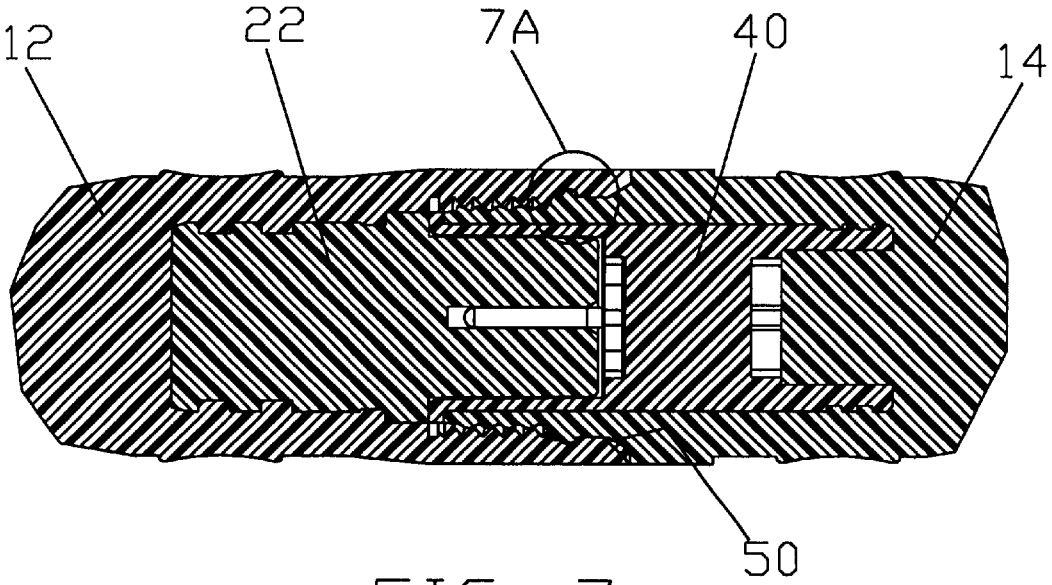
FIG. 7 is a close-up view similar to FIG. 6 without the cables and with the threads fully engaged.
Figure 13:
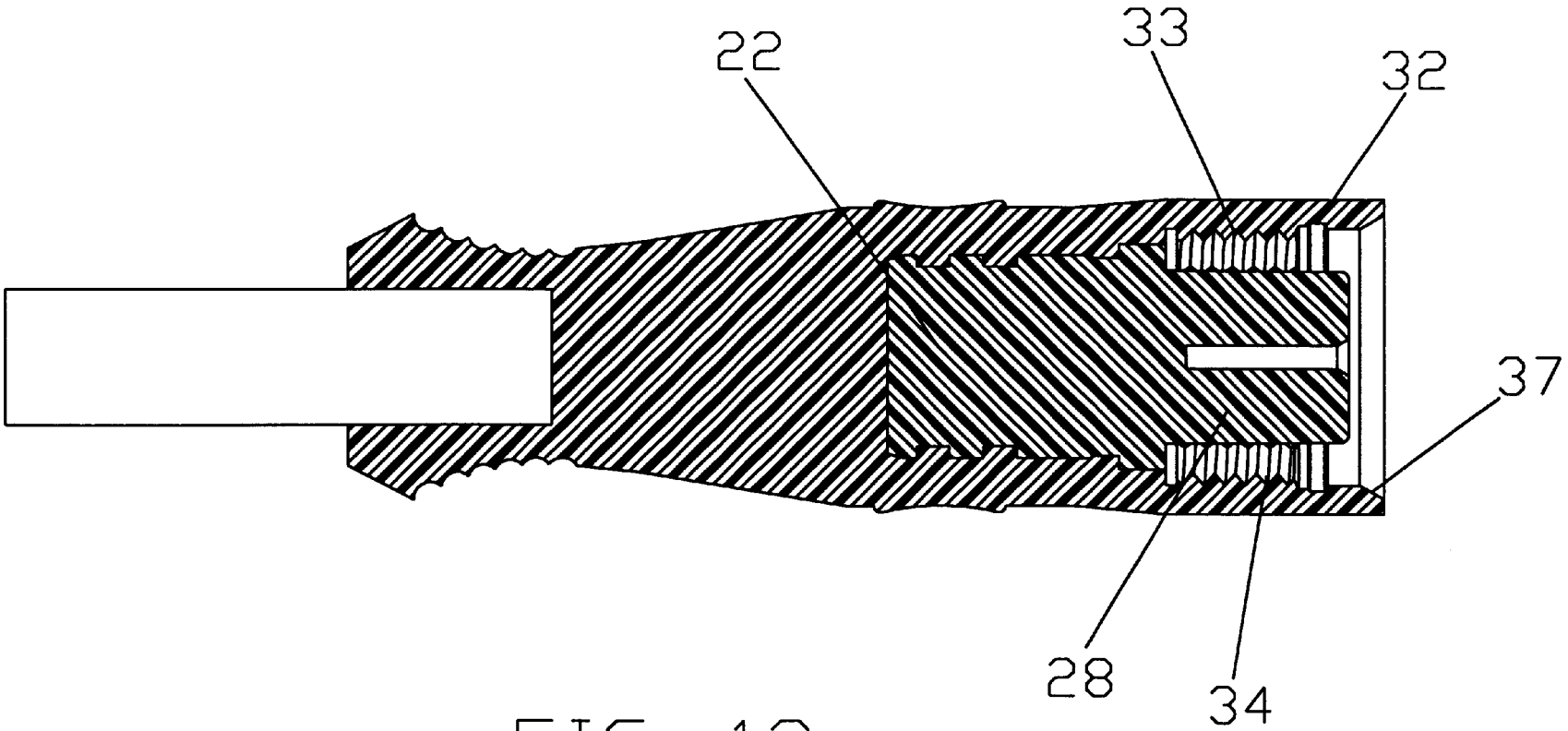
FIG. 13 is a cross section view taken along the section line 13—13 of FIG. 12.

Turning particularly to FIG. 9, the thread segments 33, 34 formed on the interior surface 29 of the peripheral wall 28 are seen to be similar to a corresponding thread formed in a rigid coupling nut of the type presently commercially available, however, the segments are not continuous around the interior of the peripheral wall 28, and the threads are molded of a flexible plastic material integral with the inner surface 29 of wall 28. An annular groove 32 is formed peripherally around the cylindrical inner surface 29 of the outer flexible wall 28 of the overmold as seen in FIGS. 7A, 11 and 13. Groove 32 need not extend completely around the wall 29, as persons skilled in the art will recognize because the two connectors do not twist relative to each other; that is, the groove could extend in segments or sectors like the threads, provided the mating rib or rib sectors on the mating connector to be described below, engage the corresponding groove or groove sectors.

Figure 14:
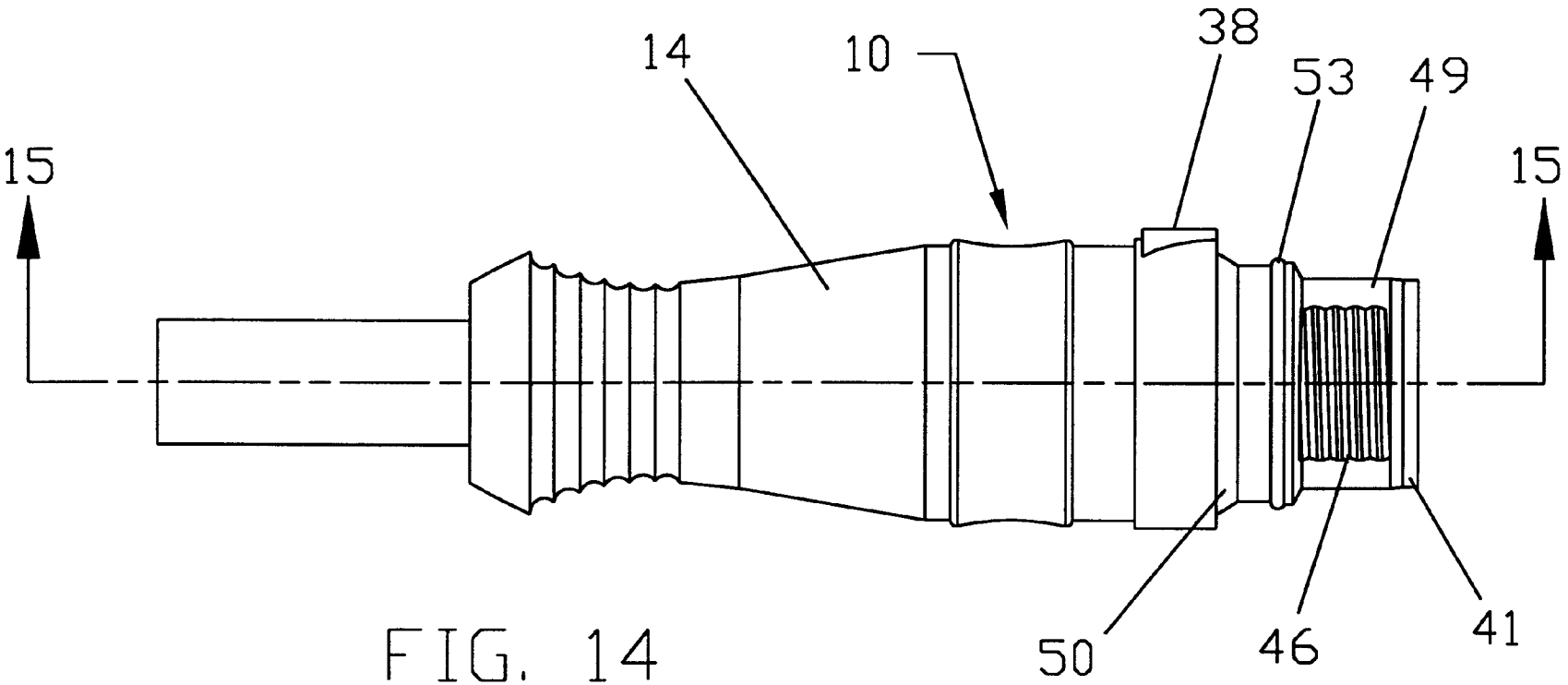
FIG. 14 is an enlarged side view of the male connector of FIG. 2.
Figure 15:
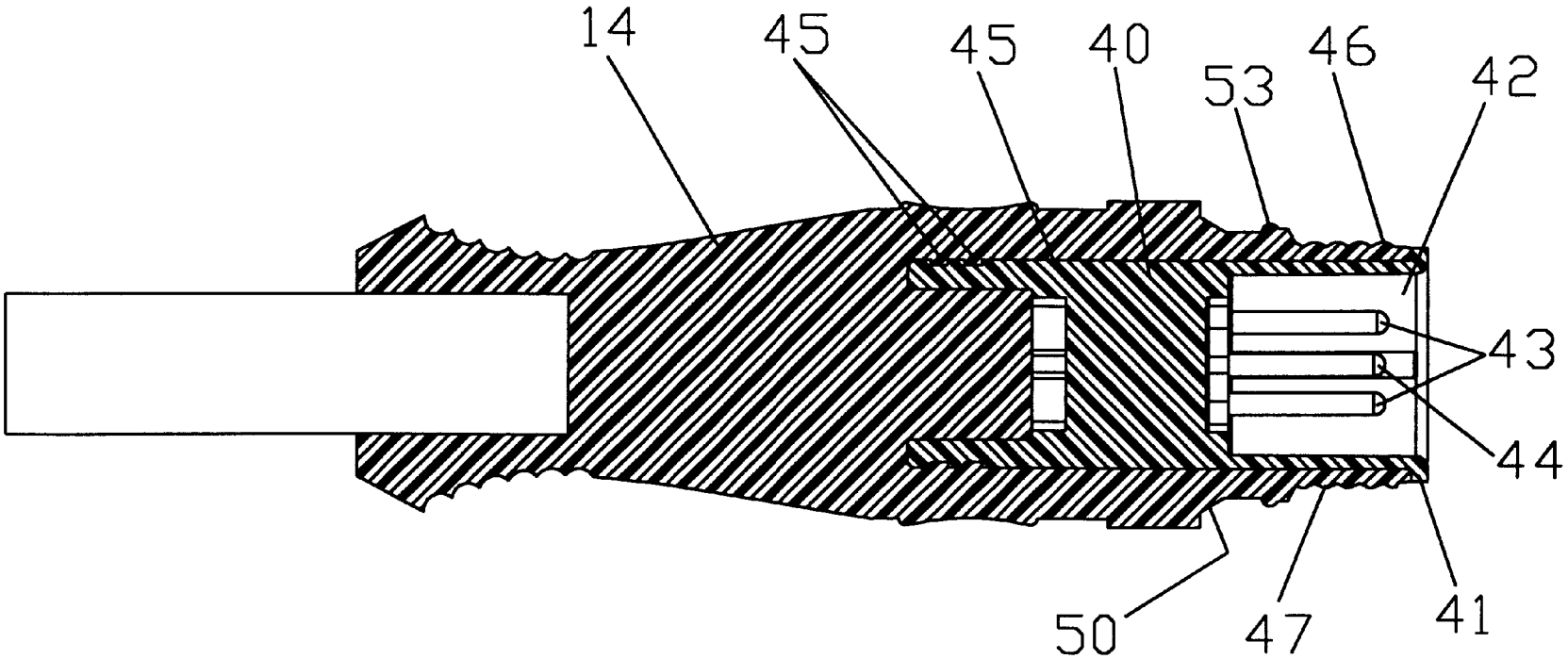
FIG. 15 is a cross section view taken along the section line 15—15 of FIG. 14.

The leading edge of the wall 28 may be chamfered as seen at 37 in FIG. 9 to provide a guide or centering surface when connecting male and female connectors, and to engage with a correspondingly chamfered surface 50 on the male connector (FIGS. 14 and 15). The interface may thus provide a seal against dust, debris and water, though the seal is not intended to be a pressure seal. FIG. 13 is a longitudinal cross section of the female connector similar to that seen in FIG. 11, but wherein the connector is rotated 90 degrees on its axis (compare the section lines of FIG. 10 and FIG. 12).

As best seen in FIG. 1, the overmold material 14 of the female connector 11 is formed to include an indicator 36 which, in the illustrated embodiment, is in the form of an arrowhead. The indicator 36 may be aligned with a similar form on the male. As best seen in FIGS. 1, 9 and 13, the outer surface of the overmold 12 of the female connector 11 is a surface of revolution contoured as generally designated at 54, including an inner end portion 55 of larger circumference reducing in diameter proceeding toward the front of the connectors. The surface is stepped or ridged to provide a shaped, recessed grip portion 56 to enhance gripping with the fingers and thumb of one hand. The outer surface of the overmold 14 of the male connector is similarly shaped, but in mirror image, as seen in FIGS. 1, 14 and 15 female connectors during assembly, as will be apparent from further description. A corresponding indicator in the form of an arrow is located on the male connector 10 and designated 38.

Turning now to FIGS. 14–17 a male insert 40, preferably formed of a rigid, insulating, suitable plastic is generally cylindrical in form and elongated axially as seen in FIG. 15. Male insert 40 includes, at its forward portion, a cavity which is generally cylindrical and designated 42 for housing a plurality of male contact or connecting elements in the form of pins 43, and a central ground pin 44. The protective overmold 14 is formed about the exterior cylindrical surface 45 of the male insert 40, and the male insert 40 also may include grooves 45 to improve the mechanical bond with the overmold 14. The forward end of the male insert 40 is formed into an outwardly extending peripheral flange 41. At the forward end of the overmold 14, there are provided first and second segments of male threads designated respectively 46 and 47 in FIG. 15.

The thread segment 46 is seen in FIG. 14, and it is formed on the outer cylindrical surface 49 of the forward most portion of the overmold 14. Forward of the indicator 38, and inboard of the cylindrical surface 49, there is the chamfered or frusto-conical surface 50 for engaging and sealing with the corresponding mating surface 37 of the female connector as described.

The male thread segments 46, 47 may also be formed as segments of a continuous male screw thread having the same pitch, thread size and diameter as the corresponding inner threads on the female connector, and as the corresponding threads on the rigid metal connectors of conventional female connectors, or they may be parallel threads in the form of ridges/grooves. The included angle of the thread segments or sectors of the male connector may also be 90 degrees, as with the corresponding female thread segments. However, the thread segments may extend in the range of 60°–120° approximately with changes in the pull force required for disconnection.

Figure 16:
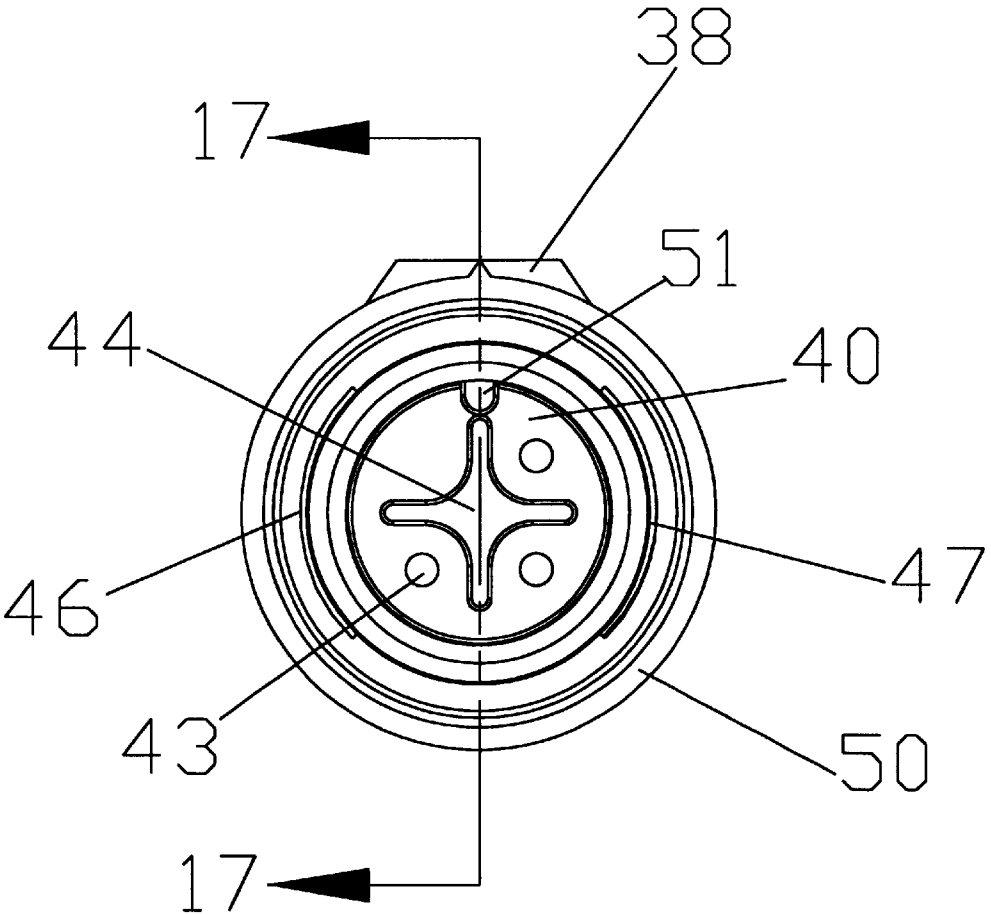
FIG. 16 is an enlarged end view of the connecting end of the male connector of FIG. 2.
Figure 17:
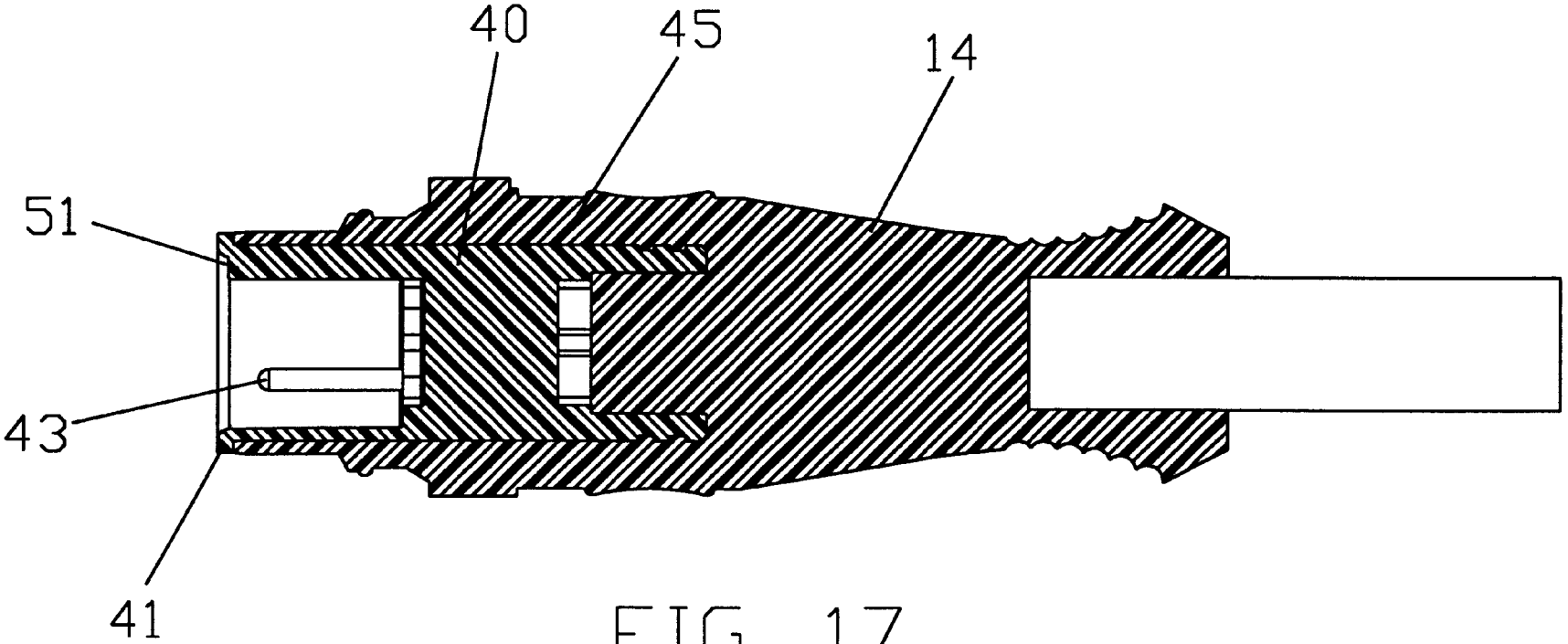
FIG. 17 is a cross section view taken along the section line 17—17 of FIG. 16.

The male insert 40 also includes a key 51 which extends axially of the connector and is sized to be received in the keyway 27 of the female insert (see FIGS. 8 and 16).

Referring now to FIG. 4, when the male connector 10 is assembled to the female connector 11, as seen in FIG. 4, the key 51 of the male insert 40 is received in the corresponding keyway 27 of the female insert 18. This not only orients and locates the corresponding connecting elements correctly, but it prevents twisting or turning of the connectors once they are connected together. The male connecting elements or pins are received in the corresponding female connecting elements or sockets; and the frusto-conical surfaces 37, 50 are in contacting relation.

As seen in FIGS. 7, 7A, 14 and 15, a peripheral rim 53 is formed in the overmold 14 of the male connector at the base or rear end of the exterior thread segments 46, 47, but raised above the threads to be seated in the annular groove 32 of the mating connector (FIG. 7A).

Figure 6:
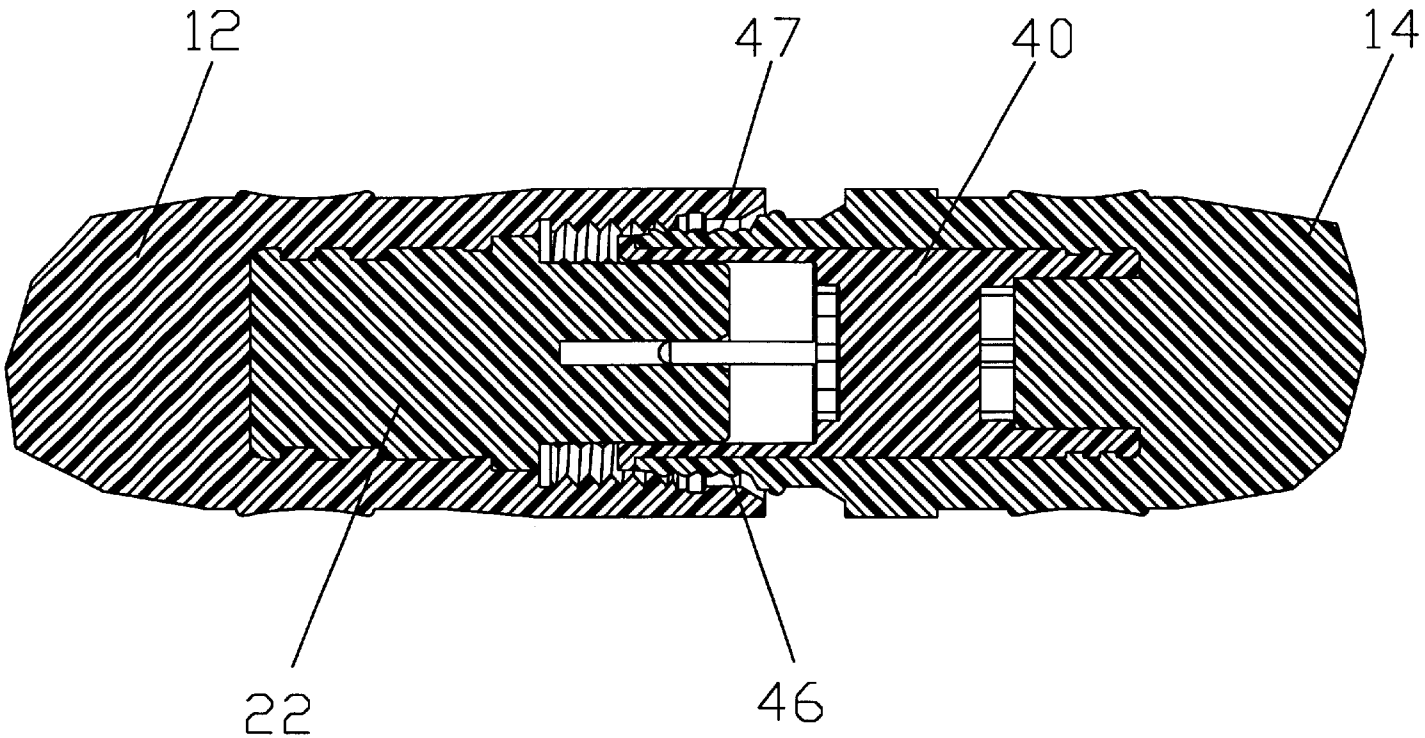
FIG. 6 is a cross sectional view of the complete male and female connectors of FIG. 1 taken along the section line 6—6 of FIG. 5 with the threads partially engaged.

FIG. 6 shows male and female connectors in partial engaging relation. Because both the male thread segments and the mating female thread segments are provided in segments rather than continuous thread, and because the cylindrical wall 28 on which the female thread segments are formed is flexible, when the two connectors are aligned and pushed together, the flexible cylindrical wall 28 of the female connector becomes somewhat elliptical. That is, it bulges out laterally as seen by the dashed line in FIG. 10, because the corresponding male threads 46, 47 push on the female thread segments 33, 34, and force them outwardly; and the opposing unthreaded portions of the wall 28 come closer together, as also illustrated by dashed line in FIG. 10. The process of assembling a male connector to a female connector gives the user a tactile, feeling indicating correct assembly as the crests of one thread segment ride over the crests and into the troughs of the mating thread segment on the mating female connector. Moreover, when a male and female connector, each having flexible thread segments or sectors are connected together, the annular rib 53 (or raised segments) is received in the annular groove 32 (or recessed segments) of the female overmold to effect a tongue-in-groove connection, thus providing a snap feeling of connection completed and improved interlock between the male and female connectors. The flexibility of the wall 28 of the female connector permits the groove to expand to receive the rib. Thus, the mechanical coupling and sealing may be improved by having the width of the groove at its opening, wider than the corresponding cross sectional dimension of the rib.

Once the thread segments are assembled, it is assured that corresponding mating thread segments are fully engaged because of the locating function performed by the key and keyway and the chamfered engaging surfaces mentioned above. The disconnect or pull force, that is, the force necessary to disconnect the male and female connectors, if both connectors are made as indicated herein, depends upon the factors described above. However, in any case, the connector of the present invention is much more resistant to unintentional disconnection through vibration or handling than are the previous connectors made of rigid, full threads and employing a coupling nut.

Moreover, the pull force needed to disconnect the instant connectors may be

Moreover, the pull force needed to disconnect the instant connectors may be varied according to the application or the intention of the manufacturer. Further, the male connector 10 (with flexible screw thread segments) may be used in combination with existing female connectors having rigid coupling nuts, and the female connector 11 may equally well be used with existing commercial connectors having rigid outer threads such as those almost universally used on sensor bodies widely found in current industrial automation applications.

Whereas in the illustrated embodiment, the flexible wall and the interior thread segments are on the female connector, and the exterior thread segment are on the male connector, they could be reversed with like results.

Having thus disclosed in detail various embodiments of the invention, persons skilled in the art will be able to modify certain of the structure which has been disclosed and to substitute equivalent materials or elements for those described while continuing to practice the principle of the invention; and it is, therefore, all such modifications and substitutions be covered as they are embraced within the spirit and scope of the independent claims.

We claim:

1. An electrical connector adapted to be connected to a mating connector comprising:

an insert of rigid insulating material;

a plurality of first connecting elements at least partially embedded in said insert;

an electrical cable including a plurality of wires, each connected to an associated one of said first connecting elements;

an overmold body molded about a portion of said insert and an adjacent portion of said cable, said overmold body including:

a generally cylindrical, flexible wall having an inner surface opposing and spaced from said insert;

at least first and second separated segments of thread integrally molded onto said inner surface, and one of a groove and a rib formed on said inner surface and located to a rear of said segments of thread for coupling to the other of said groove and rib on said mating connector.

2. The apparatus of claim 1 wherein said groove is formed on said inner surface of said flexible wall of said first-named overmold body and said mating connector comprises:

a second insert of insulating material;

a second plurality of connecting elements at least partially embedded in said second insert and adapted to connect with associated ones of said first plurality of connecting elements of said first-named connector;

a second electrical cable including a second plurality of wires, each connected to an associated one of said second connecting elements;

a second overmold body of moldable plastic material molded about a portion of said second insert and said second electrical cable and defining a cylindrical surface in opposing relation to said first-named cylindrical surface of said first-named connector when said first and second connectors are in assembled relation, said second overmold body defining at least first and second segments of flexible thread, each such segment of thread extending about said second cylindrical surface formed on said second overmold body; and wherein said rim is formed on said second cylindrical surface of said second overmold body in a position to be received in said groove when said first and second connectors are assembled and characterized in that said groove increases in width to couple to said groove when said first and second connectors are connected together.

3. The connector of claim 1 wherein said connecting elements are female and said connector is a female connector, said inner surface of said flexible wall of said overmold body is spaced from an opposing wall of said insert to define an annular region for receiving a male insert of a mating male connector.

4. The apparatus of claim 1 wherein said flexible wall of said overmold body flexes as said groove receives a mating rib to couple to said rib in firm engagement.

5. The connector of claim 4 wherein said female insert includes one of a key and keyway for assembling to the other of a key and keyway of said second connector, whereby said female connector may not be turned relative to a mating male connector to which it is assembled.

6. The apparatus of claim 3 wherein said thread segments define discontinuous sectors of a helical thread.

7. The connector of claim 6 wherein said thread segments comprise discontinuous parallel threads.

8. The connector of claim 1 wherein said connecting elements are male and said connector is a male connector; and said protective overmold includes a cylindrical outer wall providing said cylindrical surface on the exterior of said outer wall of said male insert and adapted to be received in an annular space of a mating female connector.

9. The connector of claim 8 further including a female connector comprising:

a female insert carrying female connecting elements; and an overmold body including a flexible cylindrical wall defining opposing segments of threads on opposing sides thereof, said female insert defining an outer flexible wall spaced from said cylindrical outer wall of said male connector when said male and female connectors are assembled together and corresponding thread segments of said male and female connectors are interengaged.

10. The apparatus of claim 2 characterized in that a pull force in the range of 10–30 pounds is required to disconnect said male and female connectors when assembled together.

11. The apparatus of claim 10 wherein each of said segments of thread extend about its associated cylindrical overmold surface over an included angle in the range of 60°–120°.

12. The apparatus of claim 11 wherein each of said segments of thread extend over an included angle of approximately 90°.

13. The apparatus of claim 12 wherein said peripheral wall of said female connector defines a first frusto-conical surface and said overmold body of said male connector defines a second frusto-conical surface adapted to engage and seal with said first sealing surface when said male and female connects are assembled.

14. The connector of claim 1 wherein said overmold body has an outer surface of revolution defining a circumference adjacent a rear end adjacent said cable and reducing in diameter toward a forward end to provide a contoured grip surface.

15. The connector of claim 14 wherein said contoured grip surface is stepped to enhance gripping.

* * * * *